United States Patent [19]

Garcia

[11] 4,075,615

[45] Feb. 21, 1978

[54] FREEZER ALARM

[75] Inventor: Beltran L. Garcia, Kingsville, Tex.

[73] Assignee: The Raymond Lee Organization, Inc., New York, N.Y. ; part interest to each

[21] Appl. No.: 771,920

[22] Filed: Feb. 25, 1977

[51] Int. Cl.[2] ..... H01H 37/74

[52] U.S. Cl. ..... 340/227.1; 340/220; 200/56 R

[58] Field of Search ..... 340/213 R, 220, 227 R, 340/227.1, 228 R; 200/56 R, 52 R; 116/4, 101, 103

[56] References Cited

U.S. PATENT DOCUMENTS

| | | | |
|---|---|---|---|
| 2,923,786 | 2/1960 | Jones | 200/56 R |
| 3,896,278 | 7/1975 | Murawski et al. | 200/52 R |

*Primary Examiner*—Alvin H. Waring
*Attorney, Agent, or Firm*—Daniel Jay Tick

[57] ABSTRACT

A bracket member of square U-shaped configuration having first and second spaced parallel arms and a head joining the arms and extending perpendicularly thereto rests on a wall of a freezer at the opening of the freezer with the first arm abutting the outside surface of the wall, the second arm abutting the inside surface of the wall and the head abutting the edge of the wall. A battery and an alarm are mounted on the first arm of the bracket member. A thermometer device is mounted on the second arm of the bracket member and has a column of mercury for indicating the temperature and a pair of spaced electrical contacts in the path of the column of mercury at an unsafe temperature. Electrical conductors connect the battery, the alarm and the thermometer device in a circuit whereby when the temperature in the freezer becomes unsafe as indicated when the column of mercury reaches the electrical contacts, the circuit is closed and the battery energizes the alarm.

2 Claims, 6 Drawing Figures

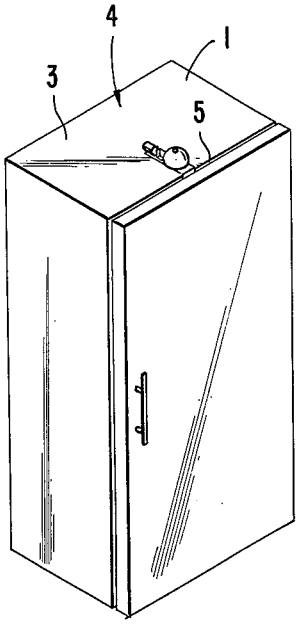
FIG. 1
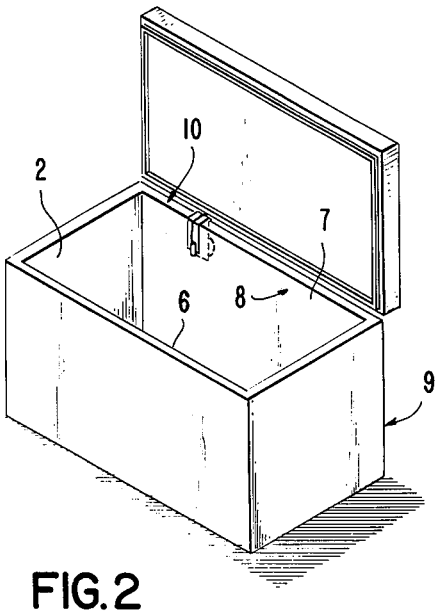
FIG. 2
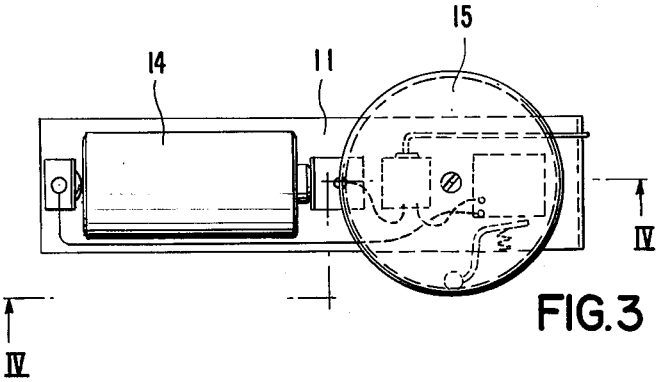
FIG. 3
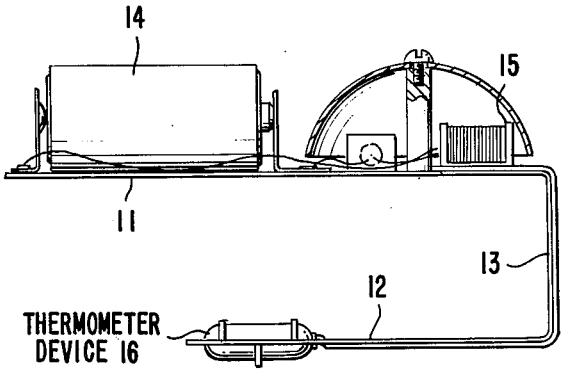
FIG. 4
FIG. 5
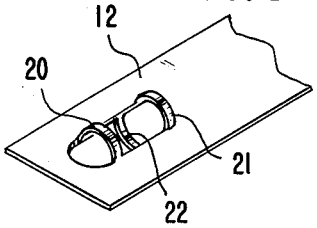
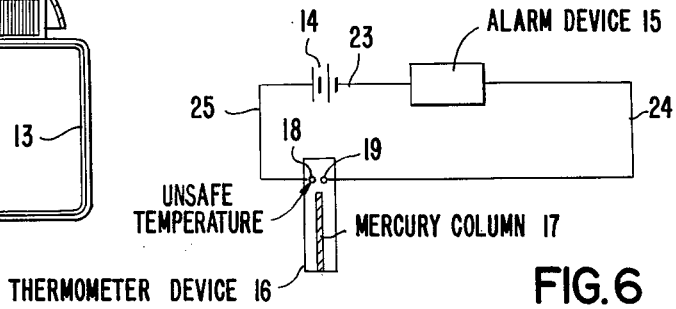
FIG. 6

FREEZER ALARM

BACKGROUND OF THE INVENTION

The present invention relates to a freezer alarm. More particularly, the invention relates to a freezer alarm for a freezer having an opening and a wall at the opening. The wall has an inside surface in the freezer, an outside surface out of the freezer and an edge at the opening between the inside and outside surfaces.

Objects of the invention are to provide a freezer alarm of simple structure, which is inexpensive in manufacture, used with facility and convenience, installable in an instant in any freezer of any type, and functions efficiently, effectively and reliably to warn when the temperature in the freezer rises to a level which is unsafe for maintaining food frozen therein.

BRIEF DESCRIPTION OF THE DRAWINGS

In order that the invention may be readily carried into effect, it will now be described with reference to the accompanying drawings, wherein:

FIG. 1 is a view of an embodiment of the freezer alarm of the invention mounted in an upright type freezer;

FIG. 2 is a view of the embodiment of FIG. 1 mounted in a chest type freezer;

FIG. 3 is a view, on an enlarged scale, of an embodiment of the freezer alarm of the invention;

FIG. 4 is a view, partly in section, taken along the lines IV—IV of FIG. 3;

FIG. 5 is a view, on an enlarged scale, of part of the bracket member of the freezer alarm of the invention; and FIG. 6 is a circuit diagram of the freezer alarm of the invention.

DETAILED DESCRIPTION OF THE INVENTION

The freezer alarm of the invention is for a freezer 1 (FIG. 1), 2 (FIG. 2), or the like. The freezer 1 has an opening (not shown in the figures) and a wall 3 at the opening having an inside surface in the freezer (not shown in the figures) and an outside surface 4 out of the freezer and an edge 5 at the opening between the inside and outside surfaces. The freezer 2 has an opening 6 and a wall 7 at the opening. The wall 7 has an inside surface 8 in the freezer, an outside surface 9 out of the freezer and an edge 10 at the opening between the inside and outside surfaces.

The freezer alarm of the invention comprises a bracket member, shown in FIG. 4, of substantially square U-shaped configuration having first and second spaced substantially parallel arms 11 and 12 and a head 13 joining the arms and extending substantially perpendicularly thereto, as shown in FIG. 4. The bracket member 11, 12, 13 rests on a wall 3, 7, or the like, of a freezer at the opening thereof with the first arm 11 abutting the outside surface 1 and 9, respectively, of the wall, the second arm 12 abutting the inside surface of the wall and the head 13 abutting the edge 5 and 10, respectively, of the wall.

A battery or batteries 14 of any suitable type, which may be rechargeable, is or are mounted on the first arm 11 of the bracket member (FIGS. 3, 4 and 6).

An alarm device 15 of any suitable type, preferably an audible alarm such as, for example, a buzzer, bell, or the like, is mounted on the first arm 11 of the bracket member. The alarm device 15 may also consist of a combination audible and visible alarm.

A thermometer device 16 (FIGS. 4 and 6) is mounted on the second arm 12 of the bracket member and has a column of mercury 17 for indicating the temperature and a pair of spaced electrical contacts 18 and 19 in the path of the column of mercury at a predetermined unsafe temperature, as shown in FIG. 6. The predetermined temperature is that at which food in the freezer will no longer remain frozen such as, for example 33° F. As a more practical matter, the predetermined temperature is between 15° F. and 20° F.

The thermometer device 16 is supported on the second arm 12 of the bracket member via a cutout portion in said arm and semiannular brackets 20, 21 and 22 (FIG. 5) around the cutout portion to support the tube containing the column of mercury 17.

Electrical conductors 23, 24 and 25 electrically connect the battery or batteries 14, the alarm device 15 and the thermometer device 16 in circuit, as shown in FIG. 6, whereby when the temperature in the freezer becomes unsafe, as indicated when the column of mercury 17 reaches the electrical contacts 18 and 19, the circuit is closed and said battery or batteries energizes or energize the alarm device 15 causing it to attract the attention of the owner or attendant of the freezer.

While the invention has been described by means of a specific example and in a specific embodiment, I do not wish to be limited thereto, for obvious modifications will occur to those skilled in the art without departing from the spirit and scope of the invention.

I claim:

1. A freezer alarm for a freezer having an opening and a wall at the opening, the wall having an inside surface in the freezer, an outside surface out of the freezer and an edge at the opening between the inside and outside surfaces, said freezer alarm comprising a bracket member of substantially square U-shaped configuration having first and second spaced substantially parallel arms and a head joining the arms and extending substantially perpendicularly thereto, said bracket member resting on a wall of a freezer at the opening thereof with the first arm abutting the outside surface of the wall, the second arm abutting the inside surface of the wall and the head abutting the edge of the wall;

battery means mounted on the first arm of the bracket member;

alarm means mounted on the first arm of the bracket member;

thermometer means mounted on the second arm of the bracket member and having a column of mercury for indicating the temperature and a pair of spaced electrical contacts in the path of the column of mercury at an unsafe temperature; and electrically conductive means connecting the battery means, the alarm means and the thermometer means in circuit whereby when the temperature in the freezer becomes unsafe, as indicated when the column of mercury reaches the electrical contacts, the circuit is closed and the battery means energizes the alarm means.

2. A freezer alarm as claimed in claim 1, wherein the alarm means is an audible alarm.

* * * * *